US006449888B1

(12) United States Patent
Gibbs

(10) Patent No.: US 6,449,888 B1
(45) Date of Patent: Sep. 17, 2002

(54) DISPLAY FRAME

(75) Inventor: Graham Rodier Gibbs, Auckland (NZ)

(73) Assignee: Rodier Advertising (1986) Limited, Albany (NZ)

( * ) Notice: Subject to any disclaimer, the term of this patent is extended or adjusted under 35 U.S.C. 154(b) by 0 days.

(21) Appl. No.: 09/450,334

(22) Filed: Nov. 29, 1999

(51) Int. Cl.[7] ..... G09F 13/04; G09F 7/00

(52) U.S. Cl. ..... 40/575; 40/572; 40/492; 40/792

(58) Field of Search ..... 40/492, 572, 575, 40/611, 734, 747, 791, 792, 793, 794, 156; 248/474

(56) References Cited

U.S. PATENT DOCUMENTS

| | | | | | |
|---|---|---|---|---|---|
| 2,154,959 | A | * | 4/1939 | Roose | 40/794 X |
| 2,416,976 | A | * | 3/1947 | Barbieri | 40/747 X |
| 3,643,362 | A | * | 2/1972 | Hackett et al. | 40/792 |
| 3,996,682 | A | * | 12/1976 | Schwartz | 40/794 |
| 4,364,192 | A | * | 12/1982 | Lloyd | 40/793 X |
| 4,750,282 | A | * | 6/1988 | Zennedjian | 40/792 |
| 4,958,458 | A | * | 9/1990 | Hillstrom et al. | 40/793 |
| 5,031,870 | A | | 7/1991 | Higgins | 248/473 |
| 5,099,590 | A | * | 3/1992 | Yamaguchi | 40/711 |
| 5,335,434 | A | * | 8/1994 | Schultz et al. | 40/766 |

FOREIGN PATENT DOCUMENTS

| | | | | |
|---|---|---|---|---|
| EP | 0328204 | | 8/1989 | |
| FR | 2342534 | * | 9/1977 | 40/156 |
| GB | 21456 | * | of 1900 | 40/156 |

* cited by examiner

*Primary Examiner*—Brian K. Green
(74) *Attorney, Agent, or Firm*—Jacobson Holman, PLLC

(57) ABSTRACT

A device for displaying signs, posters and the like for promotional and informational purposes. More particularly, adjustable display devices for holding and displaying changing signs for showing merchandise information in business establishments.

11 Claims, 5 Drawing Sheets

DISPLAY FRAME

FIELD OF INVENTION

The present invention relates to a device for displaying signs, posters and the like for promotional and informational purposes. More particularly, the invention relates to adjustable display devices for holding and displaying changing signs for showing merchandise information in business establishments.

BACKGROUND TO THE INVENTION

There are numerous devices and frames known today used for displaying various signs, messages and advertisements to the public. These devices can be positioned or secured on walls, counter tops, frames and supports or suspended from ceilings or wall surfaces.

An example of a known sign display device is disclosed in Higgins, U.S. Pat No. 5,031,870. Higgins discloses a display device for releasably supporting signs which can be positioned on a counter, cash register or the like. The device contains a frame having a slot or aperture for receiving part of display card. A manually operable mechanism is used to secure the display card to the frame.

The securing means employed in Higgins does not allow the user to display the message at various angles. Because the intended view of the message displayed may be above or below the level of the display, this disadvantage may place the message out of the intended viewer's most convenient field of vision.

Viewing and manipulation of signs is important in advertising type applications. In situations where for example fast food is being sold, it is now common for certain outlets to provide different menus at different times of the day and signage means displaying the menu do need to be changed to accommodate such varied retailing.

An object of the present invention is therefore to provide a sign display device that can accommodate signs or which will at least provide the public with a useful choice.

SUMMARY OF THE INVENTION

Accordingly in a first aspect the present invention consists in a display device for selectively receiving an indicia carrying substrate, said device comprising:

- a frame having components defining a top, sides and bottom perimeter members to define a border about the indicia carrying substrate to be carried thereby, at least one of said components includes a clamping region or regions
- at least one clamping member biased towards said clamping region or regions and between which and said clamping region, said indicia carrying substrate can be selectively clamped.

Preferably said indicia carrying substrate to be clamped at said clamping region is clamped at a perimeter region thereof.

Preferably said clamping means is biased from a part of said frame.

Preferably said clamping means is biased towards said clamping region or regions by a spring.

Preferably said spring is a leaf spring.

Alternatively said spring is a helical spring

Preferably said clamping region or regions of said at least one component is a surface directed substantially normal to the biasing force of said biasing means.

Preferably said surface is defined by an internal perimeter flange of said at least one component.

Preferably said components define a square or rectangular border for said indicia carrying substrate.

Preferably each of said components includes a said clamping region or regions.

Preferably said clamping region of each said component defines an endless internal perimeter flange of said frame.

Preferably said backing member is of a sheet material of substantially the same area as said indicia carrying substrate to be clamped.

Preferably said sheet material is of a translucent material.

Preferably a back lighting means is provided.

Preferably said frame is secured to a support means, for engagement with a support surface such as a floor, wall or ceiling.

Preferably said support means, allows for pivotal support of said frame.

Preferably said support of said frame to said support means is to allow at least substantially 180 degrees of rotation.

Preferably said frame is secured to a another frame substantially as herein described, such that the display of two of said indicia carrying substrates are each in substantially diametrically opposed directions.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples.

BRIEF DESCRIPTION OF THE DRAWINGS

One preferred form of the present invention will now be described with reference to the accompanying drawings in which.

DETAILED DESCRIPTION OF THE PREFERRED EMBODIMENTS

Figure 1:
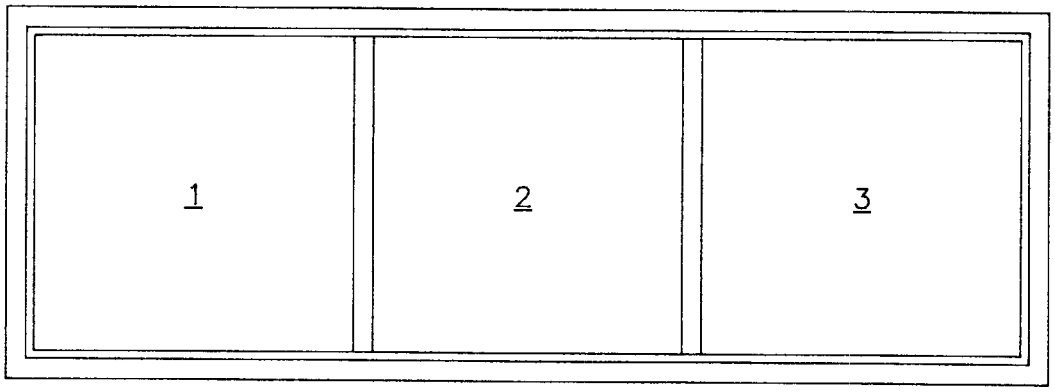
FIG. 1 is a front view of the most preferred configuration of the form of the present invention.
Figure 2:
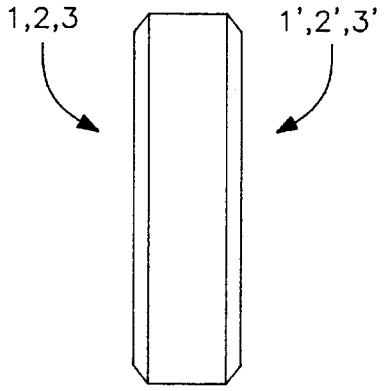
FIG. 2 is a side view of the most preferred form of the present invention.

In a broad sense the present invention consists of a frame with indica carrying substrate can be selectively located. The display means preferably provides one frame region for selectively receiving and displaying a single sheet of removable indicia however with reference to FIG. 1, them is provided at least one and preferably three, (1, 2, 3) and preferably in a side by side relationship, frame providing means to allow for three separate indicia carrying substrates to be separately and selectively removable and/or clampable by the said frames. The frame includes top and bottom and side components.

Figure 3:
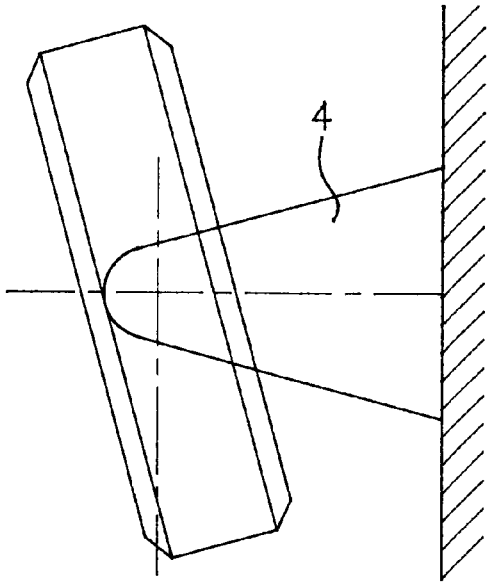
FIG. 3 illustrates the present invention engaged with a mounting means secured to a wall.
Figure 4:
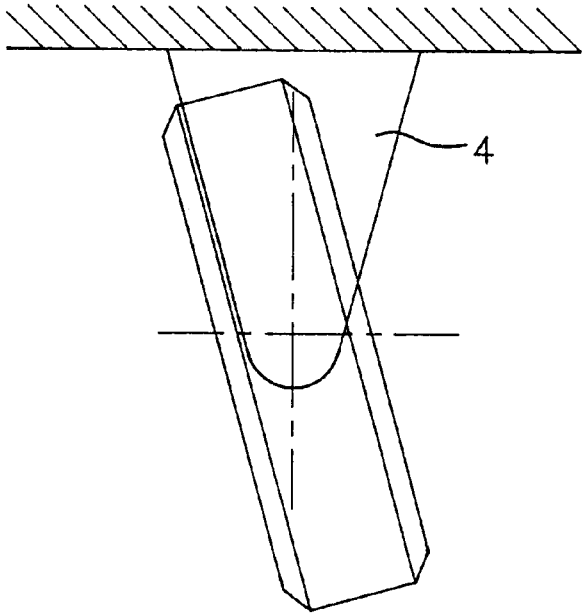
FIG. 4 illustrates the invention secured to a mounting mean suspended from a ceiling.

In the most preferred form, the display devices is also preferably double sided wherein the at least one frame (1,2,3) is substantially repeated in a diametrically opposed viewing directions of the display device as frames (1', 2', 3'). The frame is preferably mounted to a support means 4, and with reference to FIGS. 3 and 4 such a support means may locate the display means to a wall or ceiling or alternatively a floor or counter top or other suitable mounting surface. The support of the display device by the support means is preferably a pivotable support allowing the pivoting of the frame through at least 180° to allow one or the other sides of the preferred form of the display device to be viewed from a suitable direction.

The removable indicia substrates which may be secured to the display device may for example carry merchandise information such as product and/or price information which may for example be commonly found in fast food outlets or the like.

Some fast food outlets cater for different menus at different times of the day and to allow for convenient removal and replacement of product information to display the products which are appropriately for sale at certain times of the day, the device of the present invention allows for easy removal and replacement of such information carried on indicia carrying substrates.

In the most preferred form the indicia carrying substrate is preferably of a flexible sheet material and is preferably of a translucent nature. The device of the present invention is preferably back lit, and with the materials between the back lighting and the indicia carrying substrates being such as to allow light to pass there through, illumination of the product information is able to be achieved.

The indica carrying substrates may for example be a screen printed sheet material or otherwise printed sheet material and may preferably have a laminated or some other form of structure which provides some degree of rigidity to the substrate.

Figure 5:
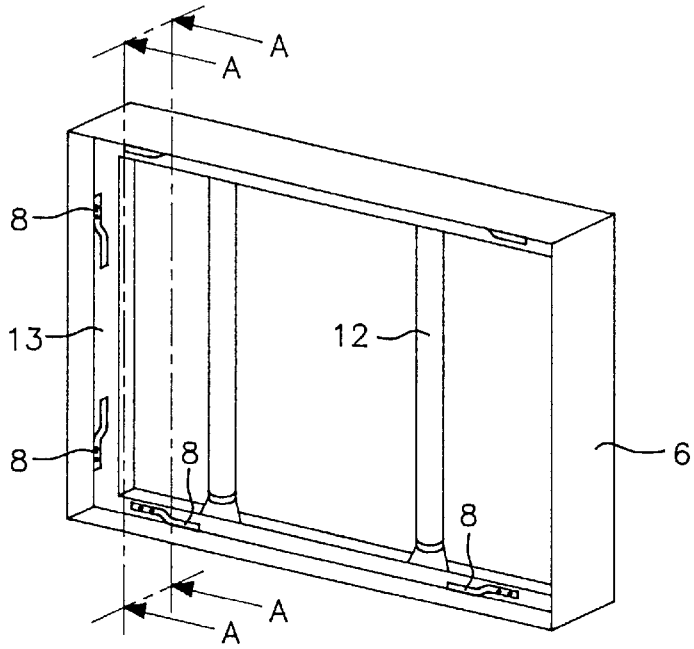
FIG. 5 illustrates a perspective view of part of the display device of the present invention showing back lighting means, biasing means and part of the frame.
Figure 6:
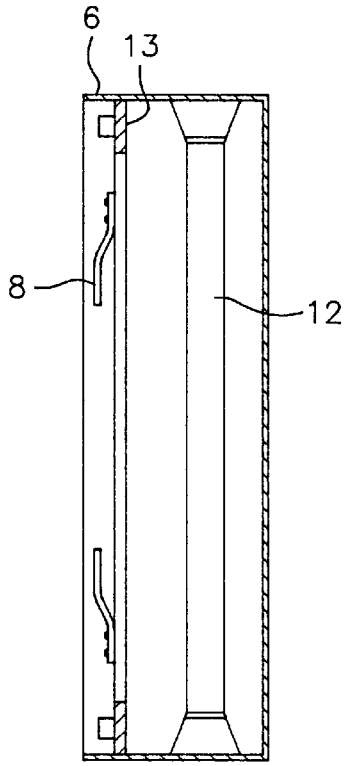
FIG. 6 is a sectional view through section A—A of FIG. 5.
Figure 7:
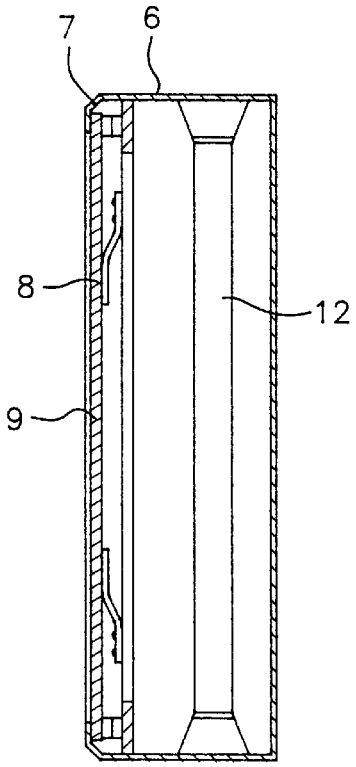
FIG. 7 is a sectional view through section A—A of FIG. 5 but wherein the clamping portions of the fame and the clamping means are illustrated.
Figure 8:
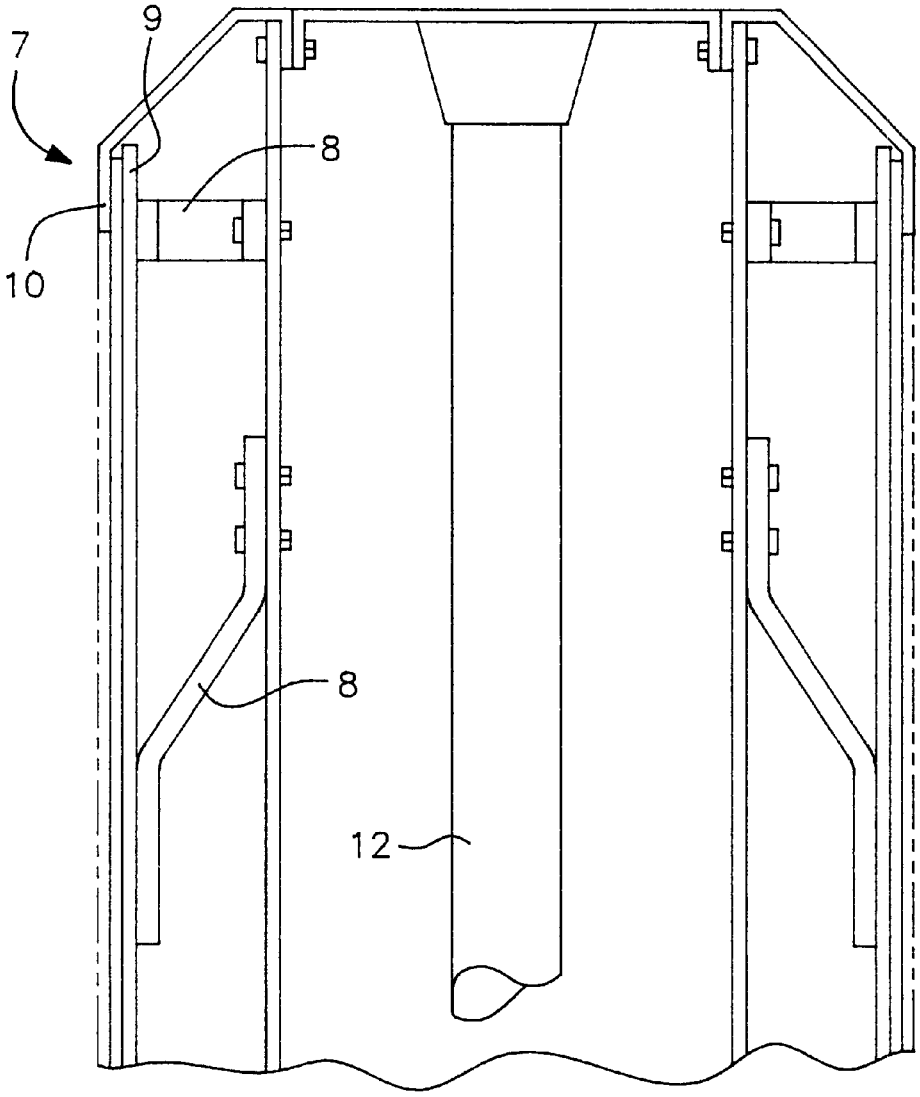
FIG. 8 is a sectional view at section A—A of FIG. 5 but wherein the display means is double sided and wherein the clamping region, clamping means and the indica carrying substrate is provided.

In a preferred form the display device consists of a frame 6. With reference to FIG. 7, the frame 6 provides a clamping region 7 which in conjunction with a clamping means which is biased by a biasing means 8 towards the clamping region, a region where at least one area of the indicia carrying substrate can be clamped to the frame is provided. The clamping region 7 (which is not shown in FIGS. 5 and 6) is preferably a flange or rim which has a surface directed towards and preferably normal towards the clamping force direction of the biasing means 8.

The clamping region 7 is preferably provided so as to provide a clamping force to substantially the entire perimeter of the indicia carrying substrate. The clamping means 9 may be of a sheet material which is of substantially the same or similar size to the indicia carrying substrate, or may alternatively be merely of a shape which provides sufficient area between the biasing means and the clamping region 7. Where in the preferred form the clamping force is provided to substantially the entire perimeter region of the indicia carrying substrate, the shape of the clamping means 9 is preferably at least of a continuous rim shaped member substantially complementary with the perimeter shape of the indicia carrying substrate.

Figure 9:
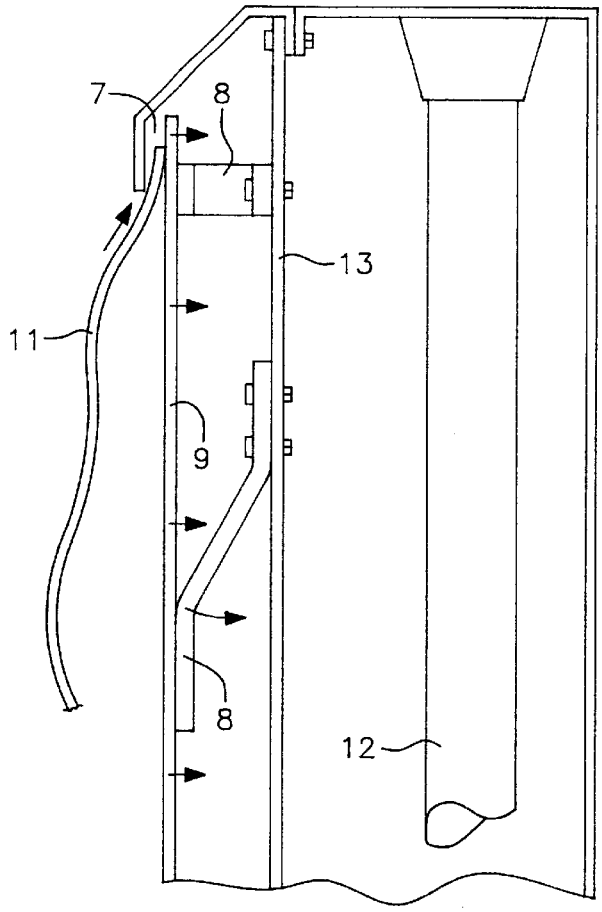
FIG. 9 is a sectional view through section A—A of FIG. 5 but wherein the display means includes the clamping region of said frame, the clamping means and partially inserted, for clamping, indica carrying means.

However in the preferred form the clamping means 9 is of a surface area which extends substantially and entirely behind the preferred endless flange providing member 10 of the clamping region 7 and covers the area defined within the frame and it acts also as a backing member for the substrate. The insertion, for clamping, of the indica carrying substrate, and with reference to FIG. 9, can hence be achieved by depressing the clamping means 9 so as it moves away from an engaged condition with the clamping region 7 and to allow for the indica carrying substrate 11 to be inserted for clamping between the clamping region and the clamping means. For convenient operation it is preferable that the clamping means is of a single sheet for each of the regions of the device to receive an indica carrying substrate. With the suitable location of a sufficient number of biasing means 8 to bias the clamping means 9 towards the clamping region, it can be appreciated that insertion of an indica carrying substrate with the frame can be conveniently and easily achieved.

Where back lighting is preferred, such is preferably achieved by a lighting means 12 which may for example be a fluorescent or incandescent lighting means. Fluorescent lighting means is preferred but it will be appreciated that alternative sources or light may be used. Where the clamping means 9 is of a preferred form which is substantially similar in area to the indica carrying means, and where back lighting is provided, the sheet material of the clamping means 9 is preferably of a translucent nature. In an alternative however the clamping means 9 may be provided with apertures therein in regions where an increased intensity of lighting is to be or may be projected from the device.

The biasing means 8 are preferably leaf springs which are provided from the frame on the other side of the clamping means to where the indicia carrying substrate is to be provided. The biasing means are preferably presented from the frame in a suitable manner and with reference to FIG. 5, these are preferably presented from the frame on a flange which extends inwardly from the frame defining means.

Figure 10:
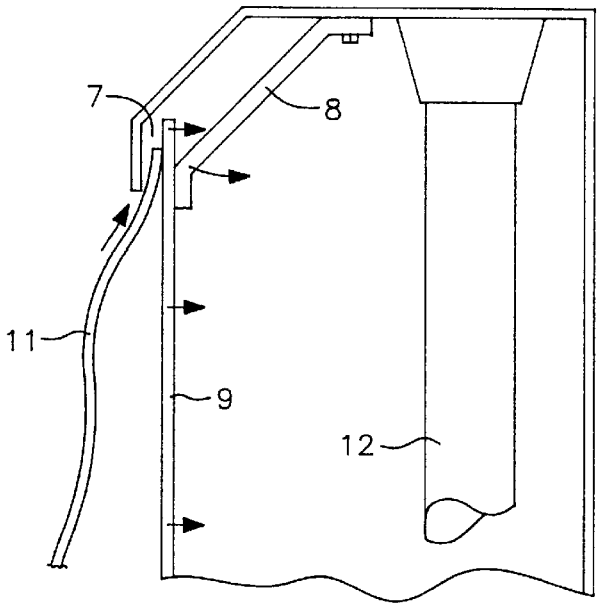
FIG. 10 is a sectional view through section A—A of FIG. 5 but wherein the display means includes the clamping region of said frame, the clamping means and partially inserted for clamping, indicia carrying means, but illustrates a different location of support of the biasing means 8.

The location providing means which is preferably a flange 13, for the biasing means 8 may however be provided in an alternative configuration. Indeed the biasing means 8 may be provided directly onto the internal perimeter of the frame, and this is as for example shown in FIG. 10.

The frame may be made in a sheet material such as a metal which is preferably powder coated or otherwise coloured. That portion of the frame defining the clamping region, may be separate from that portion of the fame which provides the lighting means and means of securing the biasing means and, as for example in FIG. 9, the portion of the frame defining the clamping region may be secured and bolted to the other portion of the frame which provides for example the lighting box and lighting means.

That portion of the frame which provides the clamping region may be made of an aluminium or other metal which is extruded to an appropriate shape to provide the flanged region 10 and other features which are desired or necessary.

What is claimed is:

1. A rotatable display device for selectively receiving an indicia carrying substrate, said rotatable display device comprising:

an indicia carrying substrate, a frame having components defining a top, sides and bottom perimeter members to define an opening having a border for the indicia carrying substrate to be carried thereby, at least one pairing of said top and bottom components and said side components defining at least one clamping region, at least one substantially rigid clamping sheet biased by biasing means towards said at least one clamping region for holding said indicia carrying substrate, and a light source located within the frame to back light said indicia carrying substrate by passage of light through said indicia carrying substrate and through said clamping sheet, said indicia carrying substrate being selectively clamped by said substantially rigid clamping sheet against said at least one clamping region, said at least one clamping region being a surface directed substantially normal to a biasing force of said biasing means, said biasing means being located between said clamping sheet and said light source and being anchored at the border of the frame for holding said indicia carrying substrate about a periphery of the indicia carrying substrate without obstructing the light projecting through said clamping sheet and through said indicia carrying substrate to illuminate said indicia carrying substrate.

2. A display device as claimed in claim 1 wherein said at least one substantially rigid clamping member is biased from a part of said frame.

3. A display device as claimed in claim 2, wherein said at least one clamping member is a sheet material backing substantially an entire area of said indicia carrying substrate to be clamped, and wherein said clamping region of each said component defines said surface as an endless internal perimeter flange for substantially an entire perimeter region of said indicia carrying substrate to clamp against.

4. A display device as claimed in claim 1 wherein said at least one substantially rigid clamping member is biased towards said at least one clamping region by a spring.

5. A display device as claimed in claim 4 wherein said spring is a leaf spring.

6. A display device as claimed in claim 1 wherein said components define a square or rectangular border for said indicia carrying substrate.

7. A display device as claimed in claim 1 wherein said indicia carrying substrate is of a translucent material.

8. A display device as claimed in claim 1 wherein said frame is secured to a support means, for engagement with a support surface such as a floor, wall or ceiling and allows for pivotal support of said frame.

9. A display device as claimed in claim 8 wherein said support of said frame to said support means is to allow at least substantially 180 degrees of rotation.

10. A display device as claimed in claim 1 wherein said frame is secured to another frame such that the display of two of said indicia carrying substrates are each in substantially diametrically opposed directions.

11. A display as claimed in claim 1, wherein said at least one clamping member is a sheet material backing substantially an entire area of said indicia carrying substrate to be clamped, and wherein said clamping region of each said component defines said surface as an endless internal perimeter flange for substantially an entire perimeter region of said indicia carrying substrate to clamp against.

* * * * *